US009706850B2

(12) United States Patent
Abu-Ulba

(10) Patent No.: US 9,706,850 B2
(45) Date of Patent: Jul. 18, 2017

(54) APPARATUS FOR SUPPORTING A FOOD ITEM

(71) Applicant: STADIUM SLEEVE ENTERPRISES LTD., Langley (CA)

(72) Inventor: Jason Abu-Ulba, Langley (CA)

(73) Assignee: STADIUM SLEEVE ENTERPRISES LTD., Langley, BC (CA)

( * ) Notice: Subject to any disclaimer, the term of this patent is extended or adjusted under 35 U.S.C. 154(b) by 0 days.

(21) Appl. No.: 14/297,599

(22) Filed: Jun. 5, 2014

(65) Prior Publication Data

US 2014/0361133 A1 Dec. 11, 2014

Related U.S. Application Data

(60) Provisional application No. 61/831,497, filed on Jun. 5, 2013.

(51) Int. Cl.

| | |
|---|---|
| ***A47B 96/06*** | (2006.01) |
| ***A47C 7/70*** | (2006.01) |
| ***A47C 7/68*** | (2006.01) |

(52) U.S. Cl.

CPC . *A47C 7/70* (2013.01); *A47C 7/68* (2013.01)

(58) Field of Classification Search

CPC .... A47C 7/70; A47C 7/68; A47C 7/62; A45F 2200/0583; B60N 2/4686; A47F 5/11; A47F 5/112; A47G 23/0208; A47G 23/0216; A47G 23/0225

USPC ..... 220/737, 738; 297/188.14, 188.18, 297/188.2; 248/152, 311.2, 214

See application file for complete search history.

(56) References Cited

U.S. PATENT DOCUMENTS

| | | | | |
|---|---|---|---|---|
| 1,915,958 | A | 6/1933 | Skirrow | |
| 3,690,724 | A | 9/1972 | Ormond et al. | |
| 4,262,962 | A | 4/1981 | Yust | |
| 4,795,211 | A | 1/1989 | Stern | |
| 4,863,134 | A | 9/1989 | Young et al. | |
| 4,893,773 | A | 1/1990 | Fujimoto | |
| 5,165,639 | A | 11/1992 | Knuppe | |
| 5,238,212 | A | 8/1993 | Dechellis | |
| 5,302,000 | A | 4/1994 | Ayotte | |
| 5,361,950 | A * | 11/1994 | Signal | B60N 3/103 224/482 |
| D353,289 | S | 12/1994 | Ayotte et al. | |
| 5,395,085 | A | 3/1995 | Mann | |
| D361,475 | S | 8/1995 | Strong | |
| 5,474,272 | A | 12/1995 | Thompson et al. | |
| 5,533,782 | A | 7/1996 | Goldman | |
| D378,334 | S | 3/1997 | Legere | |

(Continued)

FOREIGN PATENT DOCUMENTS

| | | |
|---|---|---|
| GB | 2363596 B | 12/2002 |
| GB | 2364036 B | 12/2002 |
| WO | WO 0333298 A1 | 4/2003 |

*Primary Examiner* — Christopher E Garft
(74) *Attorney, Agent, or Firm* — Alston & Bird LLP

(57) ABSTRACT

The disclosed invention pertains to apparatuses for supporting a food item. The apparatuses include a sleeve operable to slide over an armrest of a seat, wherein the sleeve is collapsible when not in use, and a support portion extending from the sleeve and being operable to receive and support the food item. The disclosed invention also pertains to blank precursors for forming the disclosed apparatuses for supporting a food item.

19 Claims, 14 Drawing Sheets

(56) References Cited

U.S. PATENT DOCUMENTS

| | | | | |
|---|---|---|---|---|
| 5,704,671 | A * | 1/1998 | van der Wal | A47G 23/0216 220/738 |
| 5,865,412 | A | 2/1999 | Mason | |
| 6,010,104 | A | 1/2000 | Hanson et al. | |
| 6,227,511 | B1 | 5/2001 | De Costa | |
| 6,371,428 | B1 | 4/2002 | Zorich et al. | |
| 6,883,765 | B2 | 4/2005 | Lozano et al. | |
| 7,243,991 | B2 | 7/2007 | Ojeda | |
| 7,743,971 | B2 | 6/2010 | DeVine et al. | |
| D673,816 | S | 1/2013 | Phillips | |
| 2001/0035484 | A1 | 11/2001 | Ellinidis et al. | |
| 2002/0148868 | A1 | 10/2002 | Dion-Bildstein et al. | |
| 2004/0200943 | A1* | 10/2004 | Rokov | A47G 23/0216 248/311.2 |
| 2005/0051690 | A1* | 3/2005 | Phillips | A47C 7/68 248/311.2 |

* cited by examiner

APPARATUS FOR SUPPORTING A FOOD ITEM

CROSS REFERENCE TO RELATED APPLICATION

This application claims the benefit under 35 U.S.C. §119 (e) of U.S. provisional application No. 61/831,497 filed Jun. 5, 2013, which is incorporated by reference in its entirety for all purposes.

BACKGROUND OF THE INVENTION

The present invention relates to holders for supporting food items.

DESCRIPTION OF RELATED ART

Patrons may purchase and consume food items, including beverages, several times in the course of a sporting or theatrical event. In the typically congested seating conditions of a stadium or theatre, a patron must consider where to store the food item when it is not being consumed. Unless the patron is willing to carry the food item continuously in his or her hand until it is completely consumed, the food item must be placed on the floor. While on the floor, the food item may be easily knocked over and spilled due to the traffic of spectators along the aisle in front of the patron, or due to the patron's own movement, for example, rising and sitting in response to the action of the event.

While many theatres or stadiums have employed beverage cup holders that are permanently secured to or formed on ends of the armrests of the seat, this practice is not universal for various reasons. First, such cup holders add to the cost of the seats. Second, minimum distances between consecutive rows of seats may be prescribed by law, e.g. for safety reasons, thereby precluding the permanent installation of a beverage cup holder extending from the armrest of a seat.

SUMMARY OF THE INVENTION

In accordance with one aspect of the invention there is provided an apparatus for supporting a food item. The apparatus includes a sleeve operable to slide over an armrest of a seat, a support portion extending from the sleeve and being operable to receive and support the food item. The food item may be a beverage container.

The sleeve may be collapsible when not in use. The sleeve may include a plurality of panels joined along edges thereof, the edges being configured to flex to permit the sleeve to be collapsed when not in use. The sleeve may include a receiving end that receives the armrest, and the plurality of panels may include a bottom panel for engaging an undersurface of the armrest of the seat. A slit may extend partway along the bottom panel from the receiving end of the sleeve. The panels may be generally rectangular in shape. The sleeve may include a joint between at least two of the plurality of panels. The joint may be a glued joint. The joint may include corresponding closure tabs operable to engage each other to join the at least two of the plurality of panels.

The support portion may be collapsible. The support portion and the sleeve may be collapsible into a generally common plane for storage in a flat condition. The support portion may include a sidewall, and the sleeve may be configured to engage and support the sidewall of the support portion when the support portion is oriented to receive the food item. The support portion may have a generally cylindrical shape and include an opening for receiving the beverage container. The support portion may have a generally frustoconical shape and include an opening for receiving the beverage container.

The apparatus may further include a connecting portion connecting the sleeve to the support portion. The support portion may be joined to the sleeve along an edge. The connecting portion may be configured to flex to permit the support portion to be oriented to receive the food item. An end of the sleeve proximate the connecting portion may be configured to engage the sidewall when the support portion is oriented in a generally upright condition to receive the food item.

At least one of the support portion and the sleeve may include a flexible material. The flexible material may include a lignocellulosic material. The support portion and sleeve may be integrally formed.

The support portion may extend outwardly from an end of the sleeve. The support portion may extend outwardly from a side of the sleeve. The support portion may extend above an upper surface of the sleeve and may be configured to be supported by the upper surface of the sleeve when in use.

In accordance with another aspect of the invention of the invention provide a blank precursor for forming an apparatus for supporting a food item. The blank precursor includes a sleeve panel operable to be folded to form a sleeve for sliding over an armrest of a seat. The blank precursor further includes a support panel for forming a support portion operable to receive and support the food item. The support panel extends from the sleeve panel.

The sleeve panel may include opposing sleeve side edges and opposing sleeve end edges, and a plurality of parallel fold lines extending between the sleeve end edges. The fold lines may be operable to permit the sleeve to be folded between a collapsed condition when not in use and an open condition for receiving the armrest of the seat.

The support panel may include opposing top and bottom edges and opposing support panel side edges. The support panel side edges may be operable to be connected to each other to configure the support panel for receiving and supporting the food item. The sleeve panel may include opposing sleeve side edges and opposing sleeve end edges, and a portion of the top edge of the support panel may be joined to the sleeve panel at one of a sleeve side edge and a sleeve end edge of the sleeve panel.

The support panel may be configured to extend above an upper surface of the sleeve panel when in use, and may further include provisions for connecting the support panel to the sleeve panel when in use. The provisions for connecting may include a tab and a corresponding notch for receiving the tab. At least one of the support panel and the sleeve panel may have an area for receiving an image thereon. The area may include a border defined by frangible lines for facilitating removal of the image from the apparatus.

In accordance with another aspect of the invention there is provided an apparatus for supporting a food item. The apparatus includes a generally tubular support portion operable to receive and support the food item. A pair of openings formed on opposite sides of the tubular support portion are configured to permit the support portion to slide over an armrest of a seat for supporting the support portion to receive a food item.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
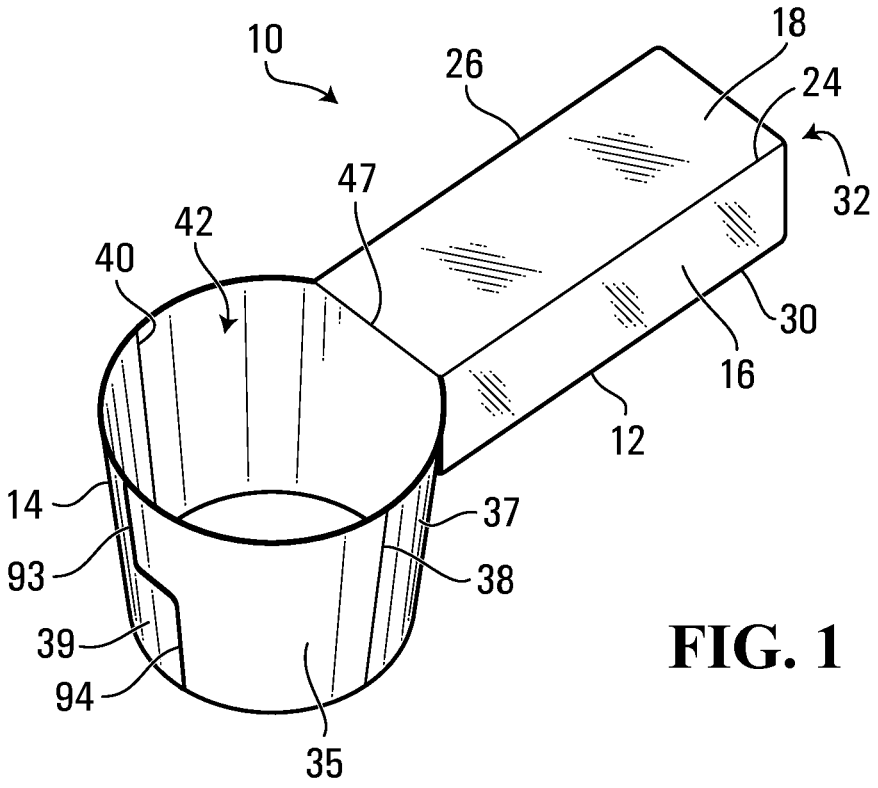
FIG. 1 is a perspective view of an apparatus for supporting a food item according to a first embodiment of the invention.
Figure 3:
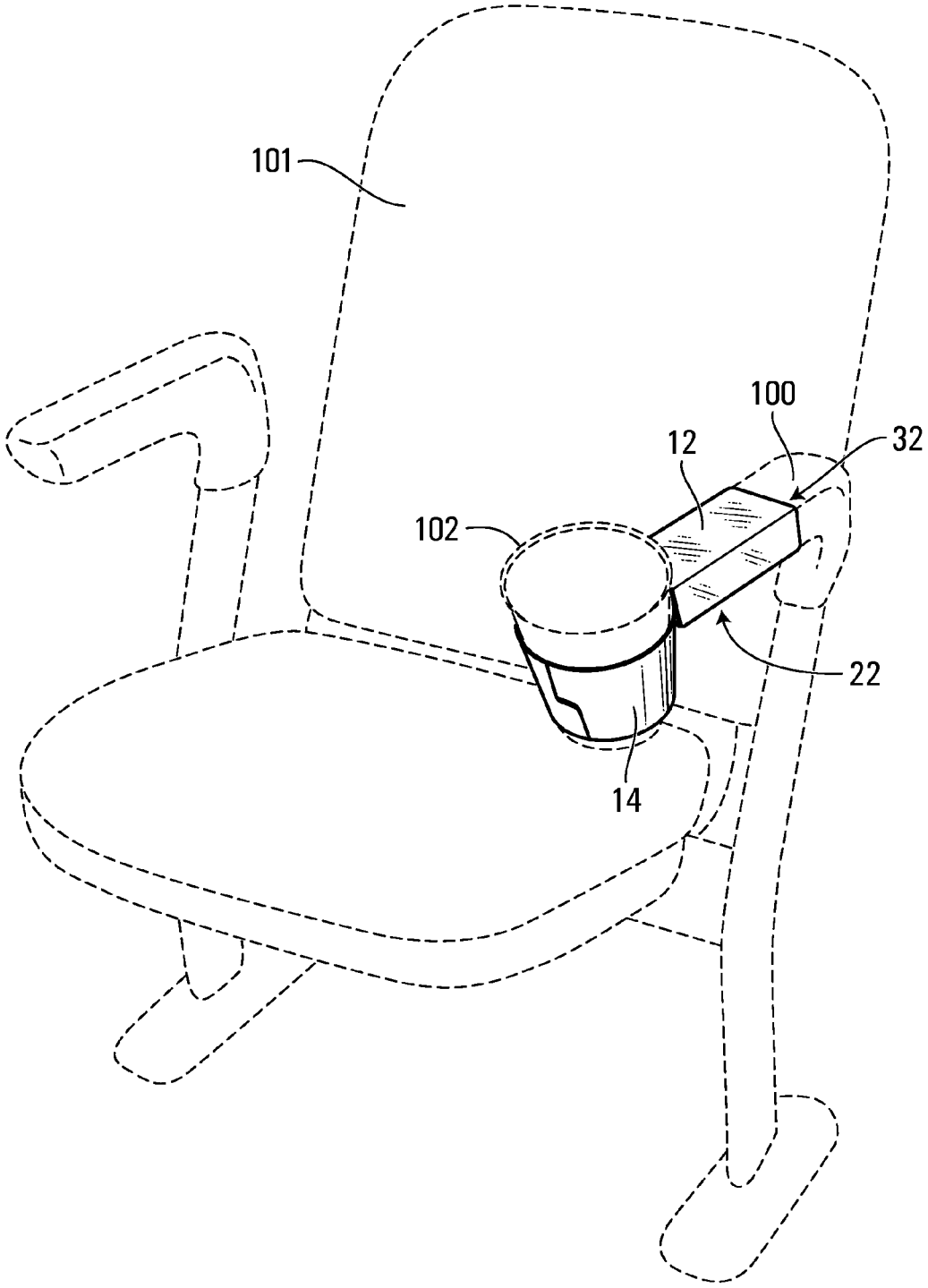
FIG. 3 is a perspective view of the apparatus shown in FIG. 1 supported on an armrest of a seat.

Referring to FIG. 1, an apparatus for supporting a food item according to a first embodiment of the invention is shown generally at 10. The apparatus 10 includes a sleeve 12, and a support portion 14 extending from the sleeve. Referring to FIG. 3, the sleeve 12 is operably configured to slide over an armrest 100 of a seat 101. More particularly, the sleeve 12 has a receiving end 32 (shown in FIG. 1) that is received on the armrest 100. The support portion 14 is operable to receive and support a food item placed therein, e.g. a beverage container 102, when the sleeve 12 is received on the armrest 100. In one embodiment the apparatus may support food items, including food and beverages. In other embodiments, the apparatus 10 may hold containers for containing and transporting food items, i.e. food containers and beverage containers (e.g. beverage cups).

Figure 2:
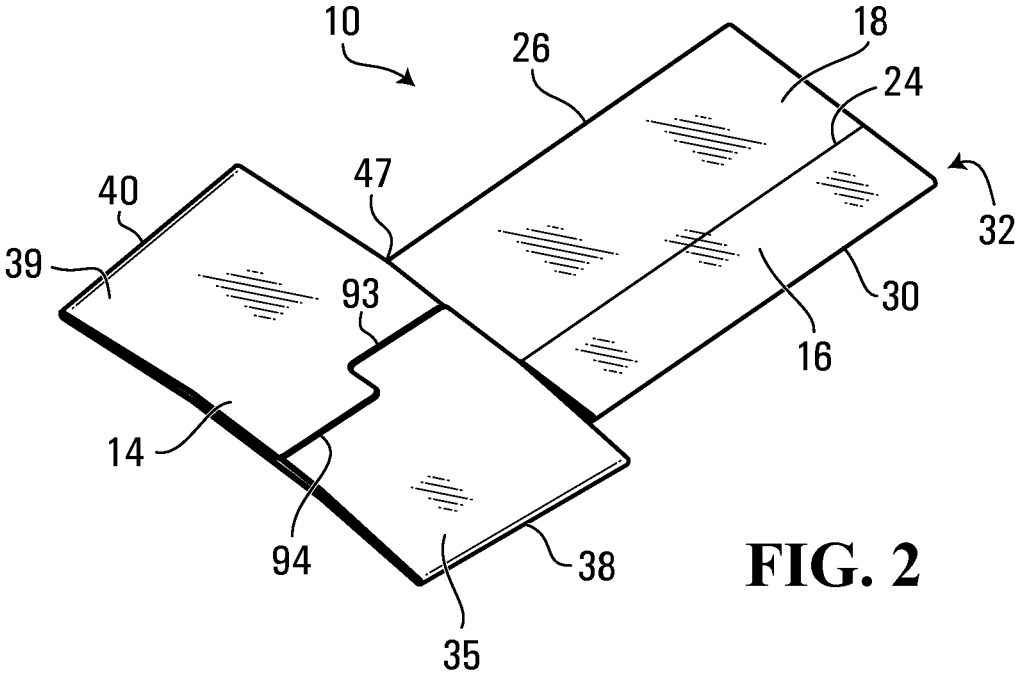
FIG. 2 is a perspective view of the apparatus shown in FIG. 1 in a collapsed state.
Figure 4:
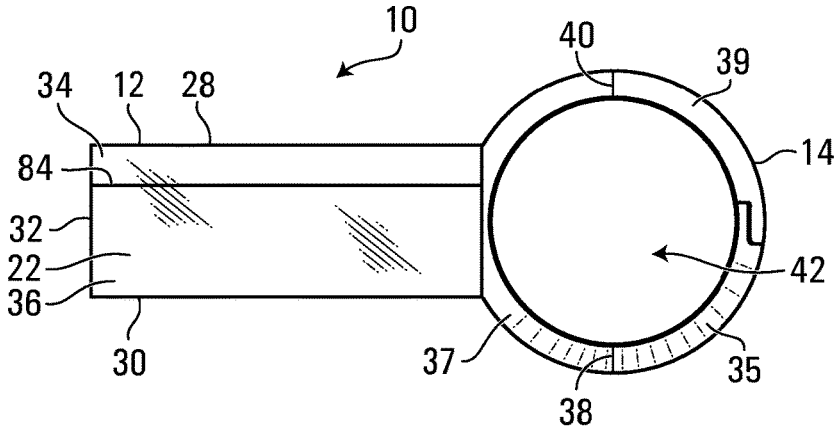
FIG. 4 is a bottom view of the apparatus shown in FIG. 1.
Figure 5:
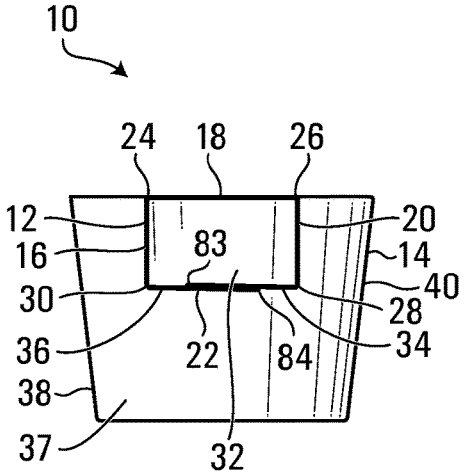
FIG. 5 is a rear view of the apparatus shown in FIG. 1.
Figure 6:
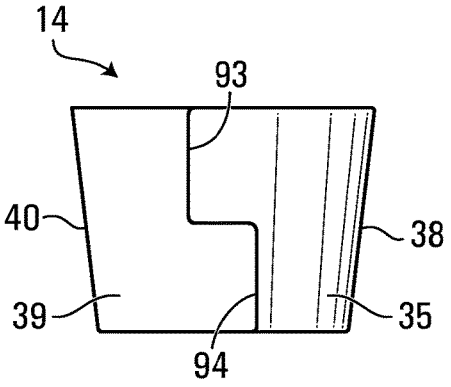
FIG. 6 is a front view of the apparatus shown in FIG. 1.
Figure 8:
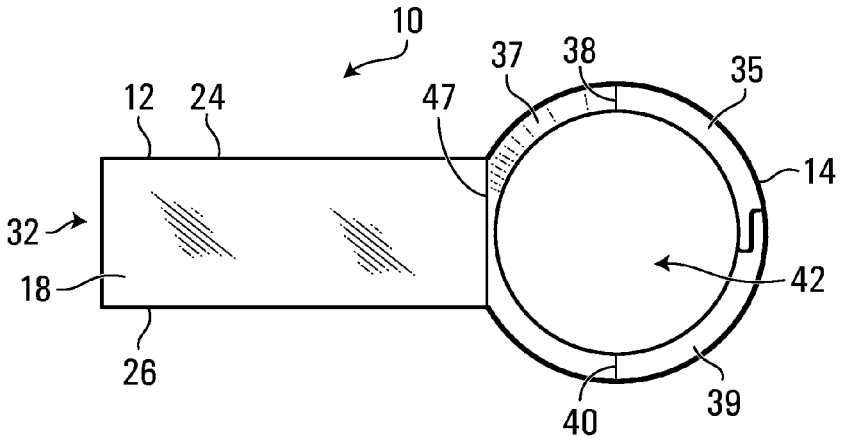
FIG. 8 is a top view of the apparatus shown in FIG. 1.
Figure 9:
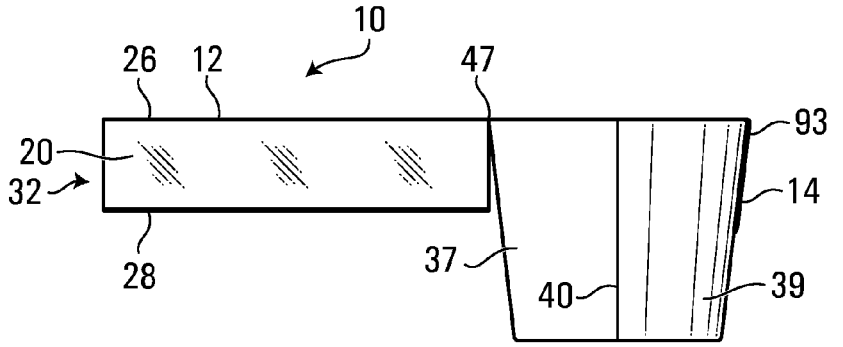
FIG. 9 is a left side view of the apparatus shown in FIG. 1.
Figure 10:
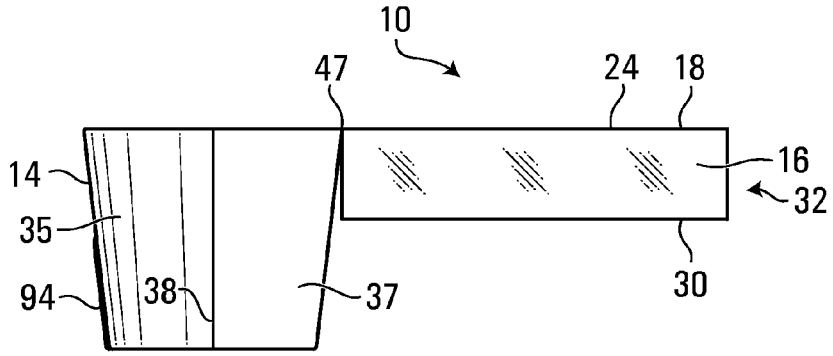
FIG. 10 is a right side view of the apparatus shown in FIG. 1.

Bottom, rear, and front views of the sleeve 12 are shown in FIGS. 4-6 respectively, while top, left and right side views are shown in FIGS. 8-10 respectively. In the embodiment shown in FIG. 1, the sleeve 12 is formed from a plurality of panels joined along sleeve edges 24, 26, 28 (shown in FIGS. 4 and 5), and 30, i.e. left panel 16, top panel 18, right panel 20, and bottom panel 22 (shown in FIG. 4) and is collapsible when not in use. The sleeve edges 24, 26, 28 (also shown in FIGS. 4 and 5) and 30 are configured to flex so as to permit the sleeve 12 to collapse flat when apparatus 10 is not in use, as shown in FIG. 2. In the illustrated embodiment, the panels 16, 18, 20 and 22 are generally rectangular in shape. However, a person skilled in the art will appreciate that the panels could have other shapes including, for example, other generally polygonal shapes.

Referring to FIGS. 4 and 5, the bottom panel 22 includes first and second bottom panel portions 34 and 36, which are joined to form the bottom panel. The first bottom panel portion 34 extends between first sleeve side edge 83 and the sleeve edge 28, whereas the second bottom panel portion 36 extends between second sleeve side edge 84 and the sleeve edge 30. The first and second bottom panel portions 34 and 36 may be joined by gluing the panel portions together using an adhesive. In other embodiments, the bottom panel portions may be joined using staples, or a clasp, or a tab extending from one of the bottom panel portions that is received and locked by a notch in the other bottom panel portion, for example.

While the illustrated embodiment shows four panels, the number of panels and their dimensions may vary depending on the geometry and cross-section of the armrest to which the apparatus is to be secured. For example, in some embodiments where the armrest has a rectangular cross section, the sleeve may have four panels, and the height of the sleeve may be between about 1 inch and about 3 inches, the width of the sleeve may be between about 1 inch and about 3.5 inches, and the length of the sleeve may be between about 1 inch and about twelve inches. In an alternative situation where the armrest has an elliptical cross section, the sleeve may include as few as two panels. In such circumstances, the sleeve may have two panels to permit the sleeve to be collapsed when not in use.

Referring again to FIG. 3, in use the bottom panel 22 engages an undersurface of the armrest 100 to retain the apparatus 10 on the armrest when a food item is received in the support portion 14. The bottom panel 22 may further include a slit extending part way along the bottom panel from the receiving end 32 towards the support portion 14 (not shown). Such a slit may provide flexibility to the sleeve 112 to permit engaging of slightly different sizes of armrests. Alternatively, the slit may serve to accommodate a structure of the seat that extends down from the undersurface of the armrest and otherwise inhibits sliding of the sleeve over the armrest.

In the embodiment shown in FIG. 3, the support portion 14 is sized to receive and support a beverage container 102. However, a person skilled in the art will appreciate that the support portion could be sized and shaped to receive any type of food item. Referring again to FIG. 1, in this embodiment the support portion 14 has a generally a frustoconical shape and includes an aperture 42 for receiving beverage containers of varying sizes. A frustoconical shaped support portion having similar sidewall angles to a beverage container advantageously provides support along the length of the support portion. In other embodiments, the support portion 14 may be generally cylindrical in shape, which would also facilitate receiving beverage containers of varying sizes.

In the embodiment shown, the support portion 14 is formed from first, second, and third sidewalls 35, 37 and 39. In other embodiments, e.g. where the support portion is formed with a mold or where the support portion is not necessarily intended to be collapsible, the support portion may be formed from as few as a single sidewall. Sidewalls 35 and 39 are joined to sidewall 37 along sidewall edges 38 and 40, respectively. The support portion 14 further is formed by joining the sidewalls 35 and 39, for example by gluing portions adjacent side edges 93 and 94 together using an adhesive. In other embodiments, the sidewalls may be joined using staples, or a clasp, or a tab extending from one of the sidewalls that is received and locked by a notch in the other sidewall, for example.

In the embodiment shown, the support portion 14 is connected to sleeve 12 by a flexible connecting portion 47. In this embodiment, the connecting portion 47 is provided by a portion of the first sleeve end edge 85 (shown in FIG. 7), along which the support portion 14 is joined to the sleeve 12. In the embodiment shown, the sleeve 12 is integrally formed with the support portion 14. In such embodiments, the sleeve 12 and/or support portion 14 may be fabricated from plastic or a lignocellulosic material, such that the connecting portion 47 forms a "living hinge" as known in the art. However, a person skilled in the art will appreciate that the connecting portion could be a separate piece of material to which one or both of the support portion and the sleeve are independently connected. The connecting portion 47 is configured to flex to permit the support portion 14 to be oriented in such a way as to receive a food item when the sleeve 12 is positioned on an armrest, e.g. the armrest 100 in FIG. 3. Furthermore, the sleeve 12 is configured to engage and support the sidewall 37 when the sleeve is on the armrest 100. In some embodiments, the connecting portion 47 may be configured to be frangible so as to permit the support portion 14 to separate from the sleeve 12 in response to a lateral force applied to the support portion when sleeve is on the armrest 100. For example, during egress of patrons from the stadium or theatre, the support portion 14 may obstruct egress of patrons but, if contacted, would tend to separate from the sleeve 12 at the frangible connecting portion 47, thereby eliminating the obstruction.

In the embodiment shown in FIG. 1, the sidewall edges 38 and 40 are configured to flex so as to permit support portion 14 to collapse flat when apparatus 10 is not in use. The sleeve edges 24, 26, 28 and 30 also facilitate collapsing of the sleeve 12 and accordingly, the support portion 14 and sleeve may be collapsed into a generally common plane for efficient packing/storage and shipment in a flat condition, as shown in FIG. 2.

In some embodiments of the invention the flexible material may include lignocellulosic material, for example, cardboard or paper. Alternatively, the flexible material may be made of plastic. Lignocellulosic materials may have the advantage of being easily recycled. Moreover, lignocellulosic material may provide printable surfaces for the inclusion of advertisements and other notice as described below.

Referring to FIG. 3, in operation, a patron in possession of a collapsed apparatus 10 may open the sleeve 12 and slide it over the armrest 100 of the seat 101. Once the sleeve 12 is on the armrest 100, the patron may open the support portion 14, and pivot the support portion downward relative to the sleeve about the connecting portion 47 to orient the support portion to receive the beverage container 102. The patron may then place the beverage container within the aperture 42 of the support portion, so that the support portion receives the beverage container, and sidewalls 35, 37, and 39 provide support for the beverage container. The sleeve 12 engages and supports sidewall 37 of support portion 14 and the weight of the beverage.

Figure 7:
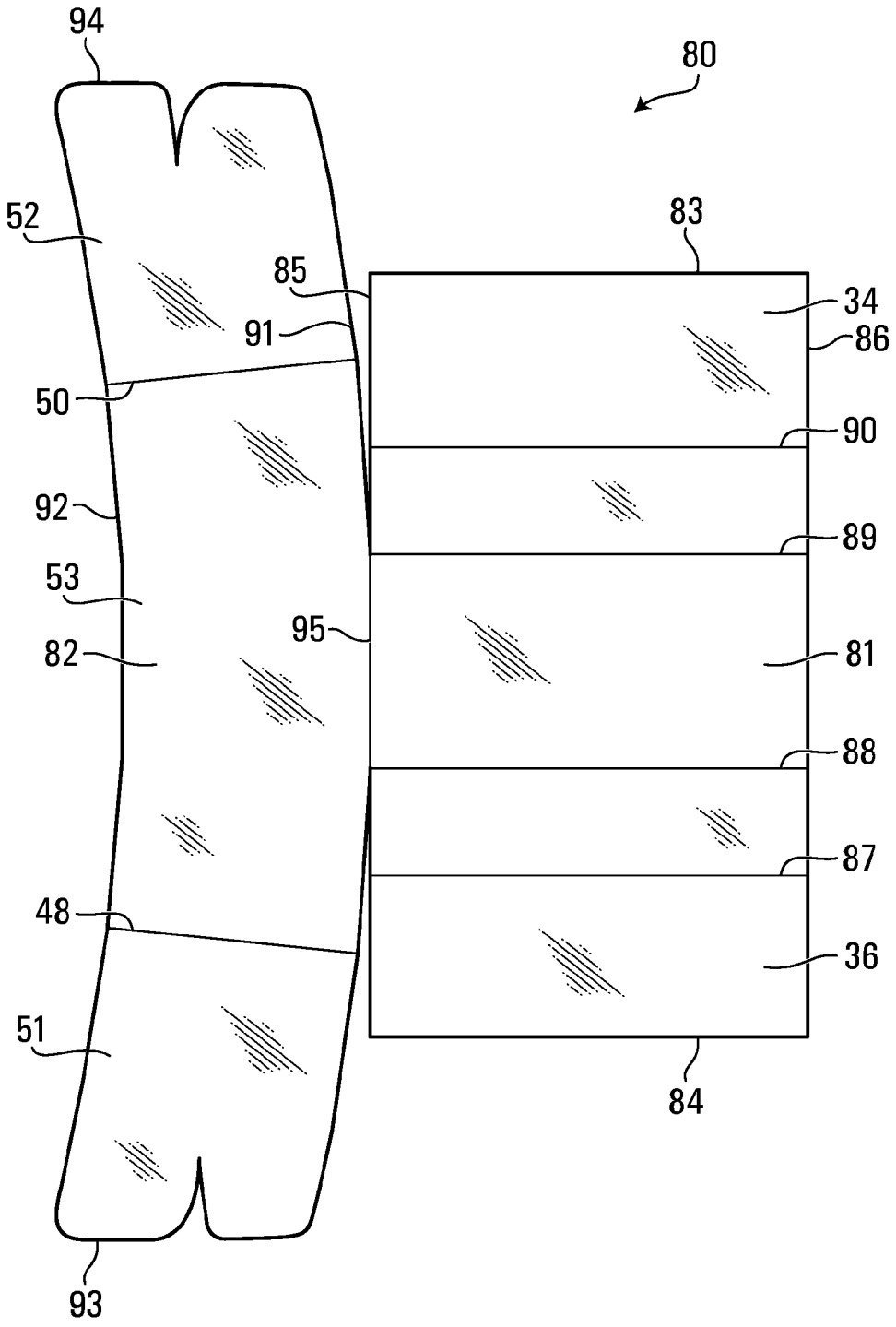
FIG. 7 is a plan view of a blank precursor for forming the apparatus illustrated in FIG. 1.

In some embodiments, the sleeve panels and support portion sidewalls may be integrally formed. For example, the panels may be formed using a mold or from a blank precursor. Referring to FIG. 7 a blank precursor for forming the apparatus shown in FIGS. 1 to 6 is shown generally at 80. The blank precursor 80 includes a sleeve panel 81 operable to be folded to form a sleeve, i.e. the sleeve 12 in FIGS. 1 to 6. The blank precursor 80 further includes a support panel 82 extending from the sleeve panel 81, which forms a support portion for receiving and supporting the food item, i.e. the support portion 14 in FIGS. 1 to 6. The sleeve panel 81 includes opposing first and second sleeve end edges 85 and 86 and a plurality of parallel fold lines 87, 88, 89 and 90. The fold lines 87, 88, 89 and 90 are located to permit the sleeve panel 81 to be folded to form the sleeve 12, as shown in FIGS. 1 to 6, such that the bottom panel portion 34 may be joined to the bottom panel portion 36. The fold lines 87, 88, 89 and 90 also provide edges 30, 24, 26, and 28, respectively, as shown in FIGS. 1 to 6, which permit the sleeve 12 to be folded between a collapsed condition when the sleeve is not in use and an open condition for being received on the armrest of the seat.

In this embodiment, the support panel 82 is generally crescent-shaped and includes opposing top and bottom edges 91 and 92, and opposing support panel side edges 93 and 94. The concave edge of the surface, i.e. the bottom edge 92, faces away from the sleeve panel 81. The support panel 82 further includes fold lines 48 and 50 which provide sidewall edges 38 and 40 when folded. A support panel portion 51 extending between the fold line 48 and the support panel side edge 93 provides the sidewall 35 shown in FIG. 1, whereas a support panel portion 52 extending between the fold line 50 and the support panel side edge 94 forms the sidewall 39 shown in FIG. 1. A support panel portion 53 between the fold lines 48 and 50 forms the sidewall 37 shown in FIG. 1. The support panel portions 51 and 52 adjacent the support panel side edges 93 and 94 may be joined to form the support portion 14, as shown in FIGS. 1 to 6.

The support panel 82 is connected to the sleeve panel 81 along a fold line 95. The fold line 95 forms the connecting portion 47 illustrated in FIGS. 1 to 5 along which the support panel 82 may be hinged with respect to the sleeve panel 81.

As disclosed above, the fold line 95 may be configured to be frangible, for example by scoring the blank precursor material along the fold line.

Figure 11:
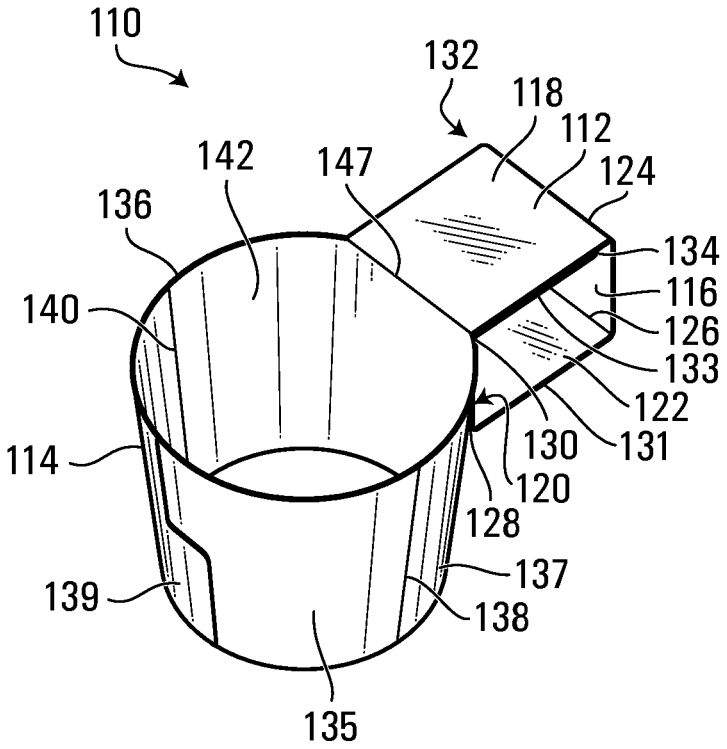
FIG. 11 is a perspective view of an apparatus for supporting a food item according to a second embodiment of the invention.
Figure 12:
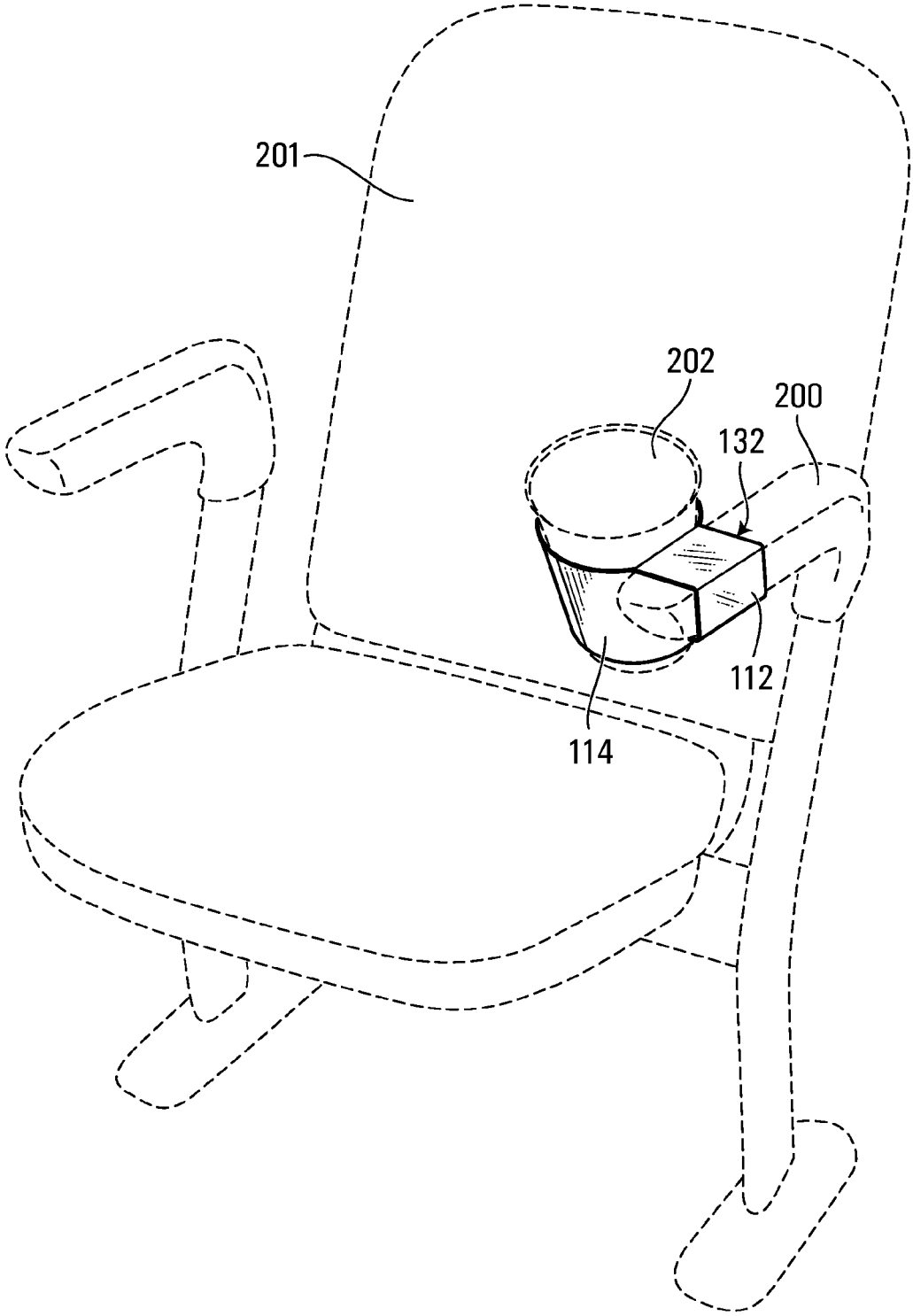
FIG. 12 is a perspective view of the apparatus shown in FIG. 10 supported on an armrest of a seat.

An apparatus for supporting a food item according to a second embodiment of the invention is shown generally at 110 in FIG. 11. Referring to FIG. 11, the apparatus 110 includes a sleeve 112, and a support portion 114 extending from the sleeve. Referring to FIG. 12, the sleeve 112 is operably configured to slide over an armrest 200 of a seat 201. More particularly, the sleeve 112 has a receiving end 132 that is received on the armrest 200. The support portion 114 is operable to receive and support a food item placed therein, e.g. a beverage container 202, when sleeve 122 is positioned on the armrest 200. In this embodiment the support portion 114 is extends inwardly from a side of sleeve 112, such that the support portion does not extend beyond an end of the armrest 200 so as to potentially obstruct movement of patrons. A blank precursor for forming the apparatus shown in FIGS. 11 and 12 is shown generally at 180 in FIG. 13.

In the embodiment shown in FIGS. 11 and 12, the sleeve 112 is collapsible when not in use. The sleeve 112 includes a back panel 116, top panel 118, front panel 120, and bottom panel 122, and the panels are joined along sleeve side edges 124, 126, 128, and 130. The sleeve side edges 124, 126, 128 and 130 are configured to flex so as to permit the sleeve 112 to collapse flat when the apparatus 110 is not in use. In the illustrated embodiment, the panels 116, 118, 120 and 122 are generally rectangular in shape. However, a person skilled in the art will appreciate that the panels could have other shapes including, for example, other generally polygonal shapes.

Referring to FIG. 11, the sleeve 112 includes a panel portion 133 that extends between the sleeve edge 130 (formed from fold line 187 in FIG. 13) and a sleeve panel side edge 134. In the embodiment shown in FIG. 11, the panel portion 133 is joined to an undersurface of the top panel 118 to form the sleeve 112. The panel portion 133 and the undersurface of the top panel 118 may be glued together using an adhesive. In other embodiments, the panel portion 133 and the undersurface of the top panel 118 may be joined using staples, or a clasp, or a tab extending from one of the panel portion and the undersurface of the top panel that is received and locked by a notch in the other of the panel portion and the undersurface of the top panel, for example.

While the embodiment shown in FIG. 11 has four panels, the number of panels may vary depending on the geometry and cross-section of the armrest to which the apparatus is to be secured. For example, where the armrest has an elliptical cross section, the sleeve may include only two panels. In such circumstances, the sleeve may have two panels to permit the sleeve to be collapsed when not in use.

Referring to FIG. 12, in use the bottom panel 122 engages an undersurface of the armrest 200 to retain the apparatus 110 on the armrest and support the sleeve 114 for receiving a food item in the support portion 114. The bottom panel 122 may further include a slit (not shown) extending part way along the bottom panel from the receiving end 132 towards a sleeve end edge 131 (formed from sleeve panel end edge 186 in FIG. 13). Such a slit may provide flexibility to the sleeve 112 to permit engaging of slightly different sizes of armrests. Alternatively a slit may serve to accommodate a structure of the seat that extends down from the undersurface of the armrest and otherwise inhibits sliding of the sleeve over the armrest.

In the embodiment shown, the support portion 114 is sized to receive and support a beverage container 202. However, a person skilled in the art will appreciate that the support portion could be sized and shaped to receive any type of food item. The support portion 114 has generally a frustoconical shape and includes an aperture 142 for receiving beverage containers 202 of varying sizes. In other embodiments the support portion 114 may be generally cylindrical in shape.

In the embodiment shown, the support portion 114 includes first, second, and third sidewalls 135, 137 and 139 that together form the support portion. In other embodiments, e.g. where the support portion is formed with a mold, the support portion may be formed from as few as a single sidewall. Sidewalls 135 and 139 are joined to sidewall 137 along sidewall edges 138 and 140, respectively. The sidewalls 135 and 139 are joined together to form the support portion 114. The sidewalls 135 and 139 may be joined by gluing portions adjacent side edges 193 and 194 together using an adhesive. In other embodiments, the sidewalls may be joined using staples, or a clasp, or a tab extending from one of the sidewalls that is received and locked by a notch in the other sidewall, for example.

In the embodiment shown, the support portion 114 is connected to the sleeve 112 by a connecting portion 147 and the sleeve is integrally formed with the support portion. In such embodiments, the sleeve and/or the support portion may be fabricated out of plastic or a lignocellulosic material, such that the connecting portion 147 is formed as a "living hinge" as known in the art. However, a person skilled in the art will appreciate that the connecting portion could be a separate piece of material to which one or both of the support portion and the sleeve are independently connected. Referring to FIG. 12, the connecting portion 147 is configured to flex to permit support portion 114 to be oriented in such a way as to receive a food item when the sleeve 112 is positioned on the armrest 200 of the seat 201. The sleeve 112 is also configured to engage and support the sidewall 137 when the sleeve is positioned on the armrest 200. In some embodiments, the connecting portion is frangible so as to permit the support portion to break away from the sleeve in response to a lateral force applied to the support portion when sleeve is on an armrest.

In the embodiment shown in FIG. 11, the sidewall edges 138 and 140 are configured to flex so as to permit the support portion 114 to collapse flat when the apparatus 110 is not in use. Accordingly, the support portion 114 and the sleeve 112 may be collapsed in a generally common plane for efficient packing/storage and shipment in a flat condition.

In the embodiment shown, one or both support portion 114 and sleeve 112 may be fabricated from a flexible, light weight material so as to permit flexing of the sleeve edges 124, 126, 128 and 130 and/or the sidewall edges 138 and 140 to facilitate collapsing of the sleeve and/or support portion when not in use. In some embodiments the flexible material may include lignocellulosic material, for example, cardboard or paper. Alternatively, the flexible material may comprise plastic. Lignocellulosic materials have the advantage of being easily recycled.

Referring to FIG. 12, in operation, a patron in possession of a collapsed apparatus 110 may open the sleeve 112 and slide it over the armrest 200 of seat 201. Once the sleeve 112 is on the armrest 200, the patron may open the support portion 114, and pivot the support portion downward relative to the sleeve about the connecting portion 147 to orient the support portion to receive beverage container 202. The patron may then place a beverage container within the aperture 142 of the support portion 114, so that the support portion receives the beverage container, and sidewalls 135, 137, and 139 support the beverage container. The sleeve 112 engages and supports the sidewall 137 of the support portion 114.

Figure 13:
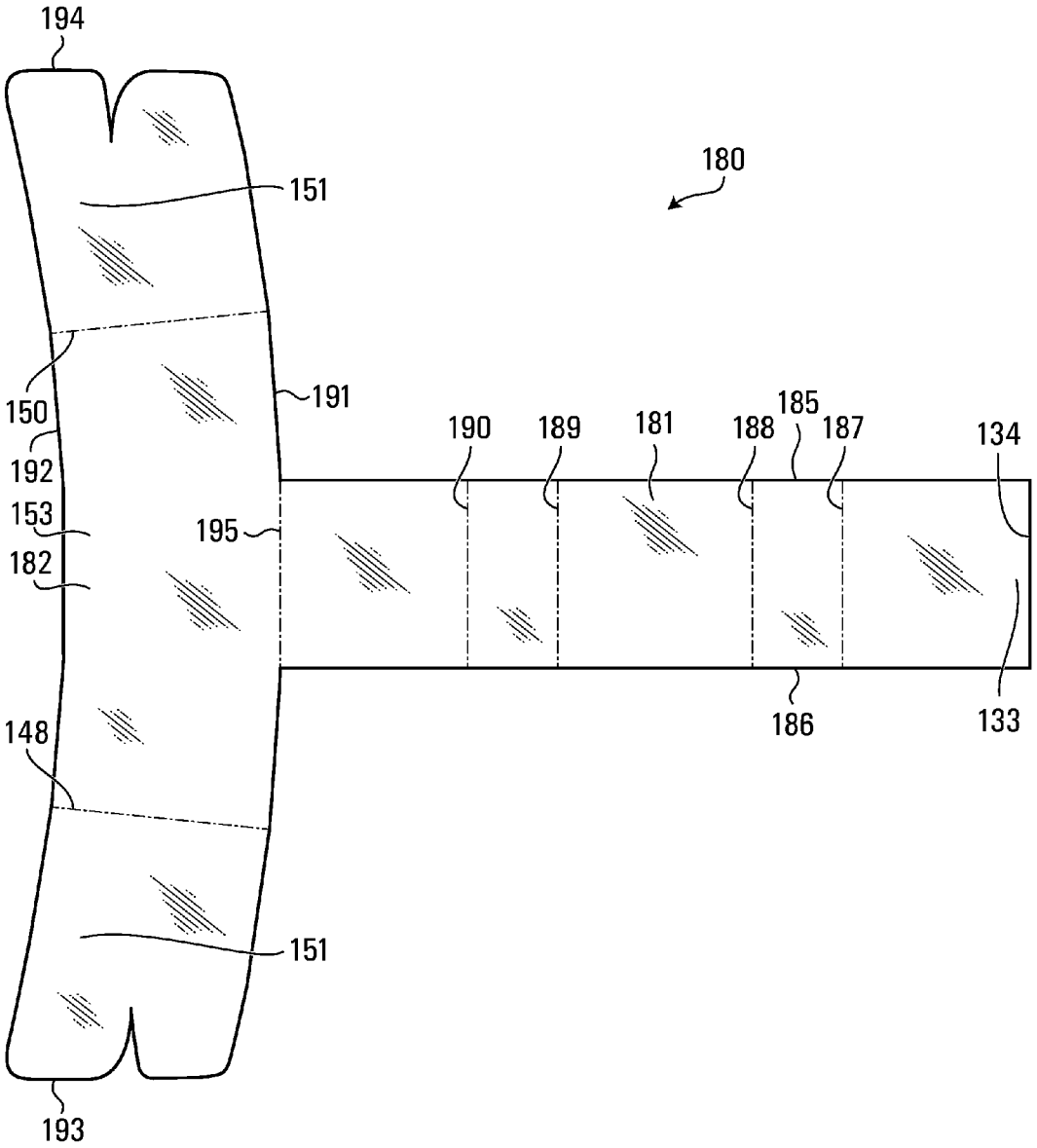
FIG. 13 is a plan view of a blank precursor for forming the apparatus illustrated in FIG. 11.

According to various embodiments of the invention, the sleeve panels and support portion sidewalls may be integrally formed. For example, they may be formed with a mold or from a blank precursor. Referring to FIG. 13, a blank precursor for forming the apparatus shown in FIGS. 11 and 12 is shown generally at 180. The blank precursor 180 includes a sleeve panel 81 operable to be folded to form a sleeve, i.e. the sleeve 112 in FIGS. 10 and 11, for sliding over the armrest of a seat. The blank precursor 180 further includes a support panel 182 extending from the sleeve panel 181, which forms a support portion for receiving and supporting the food item, i.e. the support portion 114 in FIGS. 11 and 12. The sleeve panel 181 includes opposing sleeve panel end edges 185 and 186, a sleeve panel side edge 134, and a plurality of parallel fold lines 187, 188, 189 and 190 extending between the end edges. The fold lines 187, 188, 189 and 190 are located to permit the sleeve panel 181 to be folded into the sleeve 112 as depicted in FIGS. 11 and 12, such that the panel portion 133 may be joined to the undersurface of top panel 118. The fold lines 187, 188, 189 and 190 also provide the sleeve side edges 130, 128, 126, and 124, respectively, shown in FIGS. 11 and 12, which permit the sleeve 122 to be folded between a collapsed condition when the sleeve is not in use and an open condition for receiving the armrest of the seat.

In this embodiment, the support panel 182 is crescent-shaped and includes opposing top and bottom edges 191 and 192, and opposing support panel side edges 193 and 194. The concave edge of the surface, i.e. the bottom edge 192, faces away from the sleeve panel 181. The support panel 182 further includes fold lines 148 and 150 which provide sidewall edges 138 and 140 when folded. A support panel portion 151 extending between the fold line 148 and the support panel side edge 193 forms the sidewall 135, whereas a support panel portion 152 extending between the fold line 150 and the support panel side edge 194 forms the sidewall 139. A support panel portion 153 between the fold lines 148 and 150 forms the sidewall 137. Portions of the support panel portions 151 and 152 adjacent the support panel side edges 193 and 194 may be joined to form a support portion for receiving and supporting the food item, i.e. the support portion 114 in FIG. 11. Again, the support panel portions 151 and 152 may be joined by gluing the portions together using an adhesive. In other embodiments, the support panel portions 151 and 152 may be joined using staples, or a clasp, or a tab extending from one of the sidewalls that is received and locked by a notch in the other sidewall, for example. In the illustrated embodiment, they are joined together at least by a clasp structure.

The support panel 182 is connected to the sleeve panel 181 along a fold line 195. The fold line 195 forms the connecting portion 147, shown in FIG. 11 as a fold line along which the support panel 182 may be pivoted with respect to the sleeve panel 181.

In some embodiments, the fold line 195 may be frangible to ultimately permit separation of the support portion 114 from the sleeve 112 in response to lateral force applied to the support portion.

Figure 14:
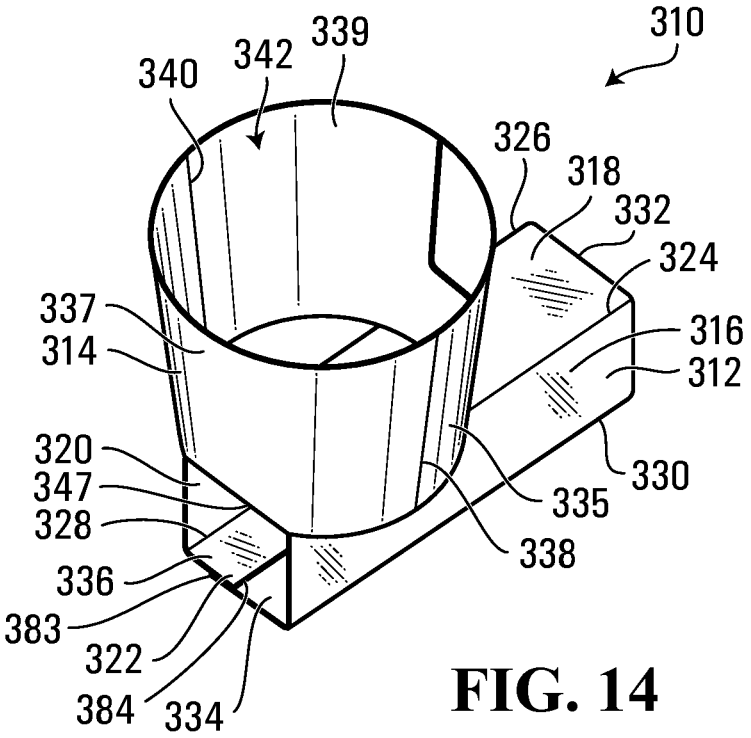
FIG. 14 is a front perspective view of an apparatus for supporting a food item according to a third embodiment of the invention.

An apparatus for supporting a food item according to a third embodiment of the invention is shown generally at 310 in FIG. 14. Referring to FIG. 14, the apparatus 310 includes a sleeve 312, and a support portion 314 extending from the sleeve. The sleeve 312 is operably configured to slide over an armrest of a seat as described above in connection with the embodiment shown in FIG. 1. The support portion 314 is operable to receive and support a food item placed therein, e.g. a beverage container, when the sleeve 312 is received on the armrest.

The sleeve 312 is formed from a plurality of panels joined along sleeve edges 324, 326, 328, and 330, i.e. left panel 316, top panel 318, right panel 320, and bottom panel 322. The sleeve edges 324, 326, 328 and 330 are configured to flex so as to permit the sleeve 312 to collapse flat when apparatus 310 is not in use (not shown). In the embodiment shown, the panels 316, 318, 320 and 322 are generally rectangular in shape. However, a person skilled in the art will appreciate that the panels could have other shapes including, for example, other generally polygonal shapes.

Figure 15:
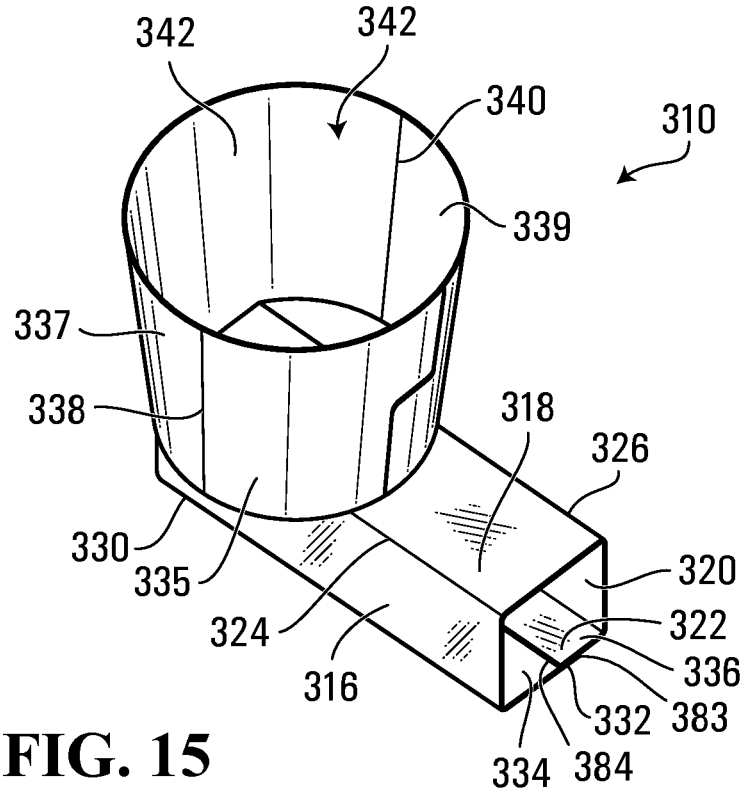
FIG. 15 is a rear perspective view of the apparatus shown in FIG. 14.
Figure 16:
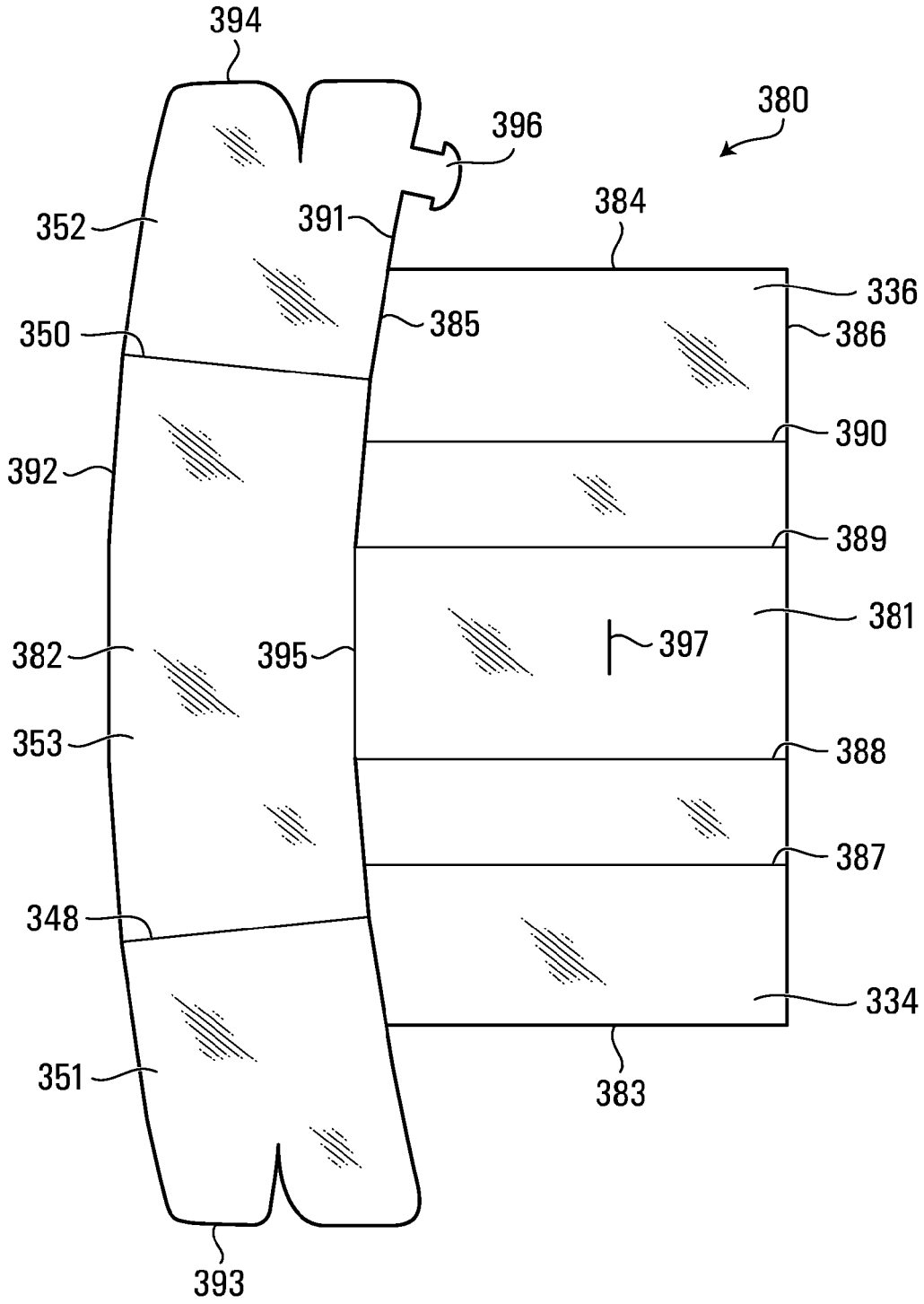
FIG. 16 is a plan view of a blank precursor for forming the apparatus shown in FIGS. 14 and 15.

Still referring to FIGS. 14 and 15, the bottom panel 322 is formed from a joint between first and second bottom panel portions 334 and 336. The first bottom panel portion 334 extends between first sleeve side edge 383 and the sleeve edge 330, whereas the second bottom panel portion 336 extends between a second sleeve side edge 384 and the sleeve edge 328. The first and second bottom panel portions 334 and 336 may be joined by gluing the panel portions together using an adhesive. In other embodiments, the bottom panel portions may be joined using staples, or a clasp, or a tab extending from one of the bottom panel portions that is received and locked by a notch in the other bottom panel portion, for example. A blank precursor for forming the apparatus shown in FIGS. 14 and 16 is shown generally at 380 in FIG. 16.

While the illustrated embodiment shows four panels, the number of panels may vary depending on the geometry and cross-section of the armrest to which the apparatus is to be secured. For example, where the armrest has an elliptical cross section, the sleeve may include as few as two panels. In such circumstances, the sleeve may have two panels to permit the sleeve to be collapsed when not in use.

In use, the bottom panel 322 engages an undersurface of an armrest to retain the apparatus 310 on the armrest. The bottom panel 322 may further include a slit extending part way along the bottom panel from the receiving end 332 towards the support portion 314 (not shown). Such a slit may provide flexibility to the sleeve 312 to permit engaging of slightly different sizes of armrests. Alternatively, the slit may serve to accommodate a structure of the seat that extends down from the undersurface of the armrest and otherwise inhibits sliding of the sleeve over the armrest. The support portion 314 has a generally frustoconical shape and includes an aperture 342 for receiving beverage containers of varying sizes. Alternatively, the support portion 314 may be generally cylindrical in shape.

In the embodiment shown, the support portion 314 is formed by first, second, and third sidewalls 335, 337 and 339. In other embodiments, e.g. where the support portion is formed with a mold, the support portion may be formed from as few as a single sidewall. Sidewalls 335 and 339 are joined to sidewall 337 along sidewall edges 338 and 340, respectively. The support portion 314 includes a joint between the sidewalls 335 and 339, which may be joined by gluing portions adjacent side edges 393 and 394 together using an adhesive. In other embodiments, the sidewalls may be joined using staples, or a clasp, or a tab extending from one of the sidewalls that is received and locked by a notch in the other sidewall, for example.

In the embodiment shown, the support portion 314 is connected to sleeve 312 by a connecting portion 347. The connecting portion 347 is provided by first sleeve end edge 385 (shown in FIG. 16), along which the support portion 314 is joined to the sleeve 312. In the embodiment shown, the sleeve 312 is integrally formed with the support portion 314. In such embodiments, the sleeve 312 and/or the support portion 314 may be fabricated from plastic or a lignocellulosic material, such that the connecting portion 347 is formed as a "living hinge" as known in the art. However, a person skilled in the art will appreciate that the connecting portion 347 may be a separate piece of material to which one or both of the support portion and the sleeve are independently connected. The connecting portion 347 is configured to flex to permit the support portion 314 to be oriented in such a way as to receive a food item when the sleeve 312 is positioned on an armrest. More particularly, in this embodiment the support portion 314 pivots upward relative to the sleeve 312 about the connecting portion 347, such that the top edge 391 (as shown in FIG. 16) rests on the top panel 318.

Referring to FIG. 16, in the illustrated embodiment, the top edge 391 of the blank precursor 380 defines a tab 396. The tab 396 is configured to be received and locked in a notch 397 on a portion the sleeve panel 381 which forms the top panel 318 to maintain the support portion 314 in position relative to the sleeve 312 when in operation. A person skilled in the art will appreciate, however, that support portion 314 could be held in position with respect to sleeve 312 by other provisions including one or more of an adhesive, a staple, and a clasp.

In some embodiments, the connecting portion 347 may be frangible so as to permit the support portion 314 to separate from the sleeve 312 in response to a lateral force applied to the support portion when the sleeve is on the armrest.

In the embodiment shown in FIGS. 14 and 15, the sidewall edges 338 and 340 are configured to flex so as to permit support portion 314 to collapse flat when apparatus 310 is not in use. Accordingly, support portion 314 and sleeve 312 may be collapsed in a generally common plane for efficient packing/storage and shipment in a flat condition. The support portion 314 and sleeve the 312 may be fabricated from a flexible material so as to permit flexing of the sleeve edges 324, 326, 328 and 330 and/or the fold lines 338 and 340 to facilitate collapsing of the sleeve and/or support portion when not in use. In some embodiments of the invention the flexible material may include lignocellulosic material, for example, cardboard or paper. Alternatively, the flexible material may be made of plastic. Lignocellulosic materials may have the advantage of being easily recycled. Moreover, lignocellulosic material may provide printable surfaces for the inclusion of advertisements and other notice as described below.

In operation, a patron in possession of a collapsed apparatus 310 may open the sleeve 312 and slide it over the armrest of a seat. Once the sleeve 312 is on the armrest, the patron may open the support portion 314, and pivot the support portion upward relative to the sleeve about the connecting portion 347 to orient the support portion to receive a beverage container. The tab 396 may then be inserted and locked in notch 397 to hold support portion 312 in position relative to the sleeve 312. The patron may then place the beverage container within the aperture 342 of the support portion, so that the support portion receives the beverage container and the sidewalls 335, 337, and 339 support the beverage container. The sleeve 312 and the armrest thus provide support to the support portion 314 and beverage container from below.

The sleeve panels and support portion sidewalls may be integrally formed, for example using a mold or from a blank precursor. Referring to FIG. 16, the blank precursor 380 includes a sleeve panel 381 operable to be folded to form a sleeve, i.e. the sleeve 312 in FIGS. 13 and 14. The blank precursor 380 further includes a support panel 382 extending from the sleeve panel 381, which forms a support portion for receiving and supporting the food item, i.e. the support portion 314 in FIGS. 14 and 15. The sleeve panel 381 includes opposing first and second sleeve end edges 385 and 386 and a plurality of parallel fold lines 387, 388, 389 and 390. The fold lines 87, 88, 89 and 90 are located to permit the sleeve panel 381 to be folded into the sleeve 312 as depicted in FIGS. 15 and 15, such that the bottom panel portion 334 is joined to the bottom panel portion 336. The fold lines 387, 388, 389 and 390 also provide respective edges 330, 324, 326, and 328 that permit the sleeve 312 to be folded between a collapsed condition, when the sleeve is not in use, and an open condition for being positioned on the armrest of the seat.

In this embodiment, the support panel 382 is generally crescent-shaped and includes opposing top and bottom edges 391 and 392, and opposing support panel side edges 393 and 394. The concave edge of the surface, i.e. the top edge 391, faces the sleeve panel 381 and the support panel 382 further includes fold lines 348 and 350 which provide sidewall edges 338 and 340 when folded. A support panel portion 351 extending between the fold line 348 and the support panel side edge 393 forms sidewall 335 shown in FIG. 14, whereas a support panel portion 352 extending between the fold line 350 and the support panel side edge 394 forms the sidewall 339 shown in FIG. 14. A support panel portion 353 between the fold lines 348 and 350 forms the sidewall 337 shown in FIG. 14. Portions of the support panel portions 351 and 352 adjacent the support panel side edges 393 and 394 may be joined to form a support portion for receiving and supporting a food item, i.e. the support portion 14 in FIGS. 14 and 15. Again, the support panel portions 351 and 352 may be joined by gluing the portions together using an adhesive. In other embodiments, the support panel portions 351 and 352 may be joined using staples, or a clasp, or a tab extending from one of the sidewalls that is received and locked by a notch in the other sidewall, for example. In the embodiment shown, they are joined together at least by a clasp structure.

The support panel 382 is connected to the sleeve panel 381 along the fold line 395. The fold line 395 forms the connecting portion 347 shown in FIGS. 14 and 15 as a fold line along which the support panel 382 may be pivoted with respect to the sleeve panel 381.

In various embodiments, the fold line 395 may be frangible to ultimately permit separation of the support portion 14 from the sleeve 12 in response to lateral force applied to the support portion, e.g. during egress of patrons from a stadium or theatre.

Figure 17:
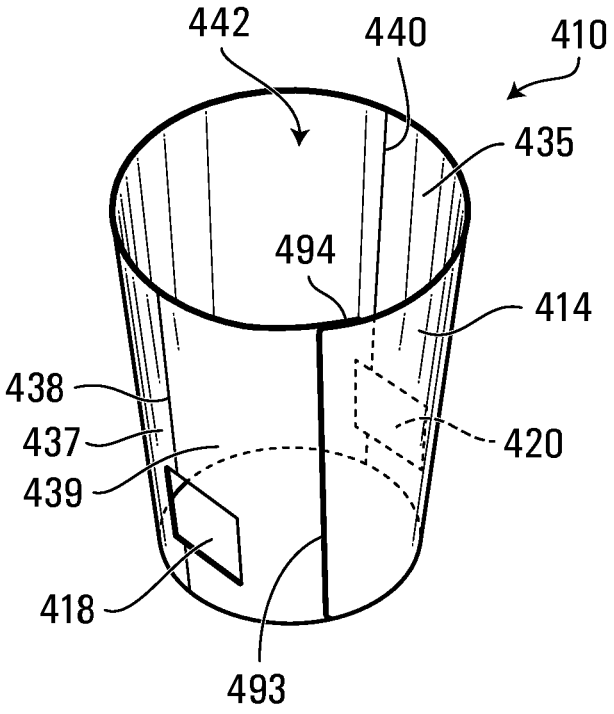
FIG. 17 is a perspective view of an apparatus for supporting a food item according to a fourth embodiment of the invention.

An apparatus for supporting food item according to a fourth embodiment of the invention is shown in FIG. 17 generally at 410. Referring to FIG. 17, the apparatus 410 includes a generally tubular support portion 414. The support portion 414 is formed from first, second, and third sidewalls 435, 437 and 439. In other embodiments, e.g. where the support portion is formed using a mold, the support portion may be formed from as few as a single sidewall. Sidewalls 435 and 439 are joined to sidewall 437 along sidewall edges 438 and 440, respectively. The support portion 414 comprises a joint between the sidewalls 435 and 439. The sidewalls 435 and 439 may be joined by gluing portions adjacent side edges 493 and 494 together using an adhesive. In other embodiments, the sidewalls may be joined using staples, or a clasp, or a tab extending from one of the sidewalls that is received and locked by a notch in the other sidewall, for example.

Figure 19:
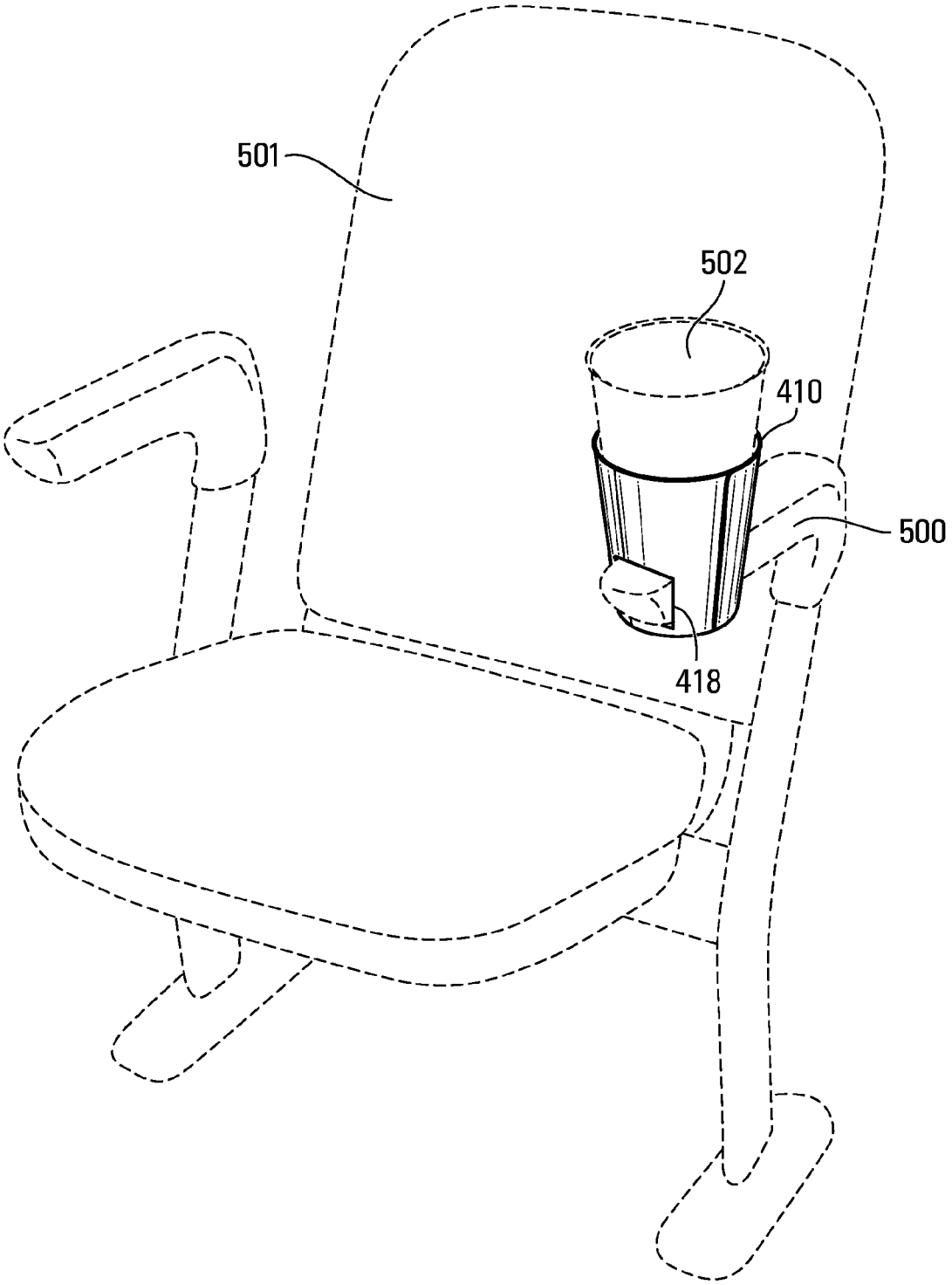
FIG. 19 is a perspective view of the apparatus shown in FIGS. 17 and 18 supported on an armrest of a seat.

In the embodiment shown, the sidewalls 435, 437 and 439 include opposed apertures 418 and 420, in which the aperture 418 is defined in the sidewalls 435 and 437 and the aperture 420 is defined in the sidewalls 437 and 439. Referring to FIG. 19, in use, the opposed apertures 418 and 420 are configured to permit the support portion 414 to slide over an armrest 500 of a seat 501.

The sidewall edges 438 and 440 are configured to flex so as to permit the apparatus 410 to collapse flat when not in use, as described above in connection with the embodiment of FIG. 1 and other embodiments. A person skilled in the art will understand, however, that the apparatus may be comprising of a single sidewall that does not have edges as shown, and the single sidewall may define both of the opposed apertures.

Referring to FIG. 19, in operation, a patron in possession of a collapsed apparatus 410 may open support portion 414 and thread armrest 500 of seat 501 through opposed apertures 418 and 420. Once support portion 414 is engaged with armrest 500, the patron may place a beverage container 502 within the aperture 442 of support portion, so that the support portion receives the beverage container and the sidewalls 435, 437 and 439 support the beverage container from the side. The armrest 500 may also provide support for the bottom of the beverage container 502.

Figure 18:
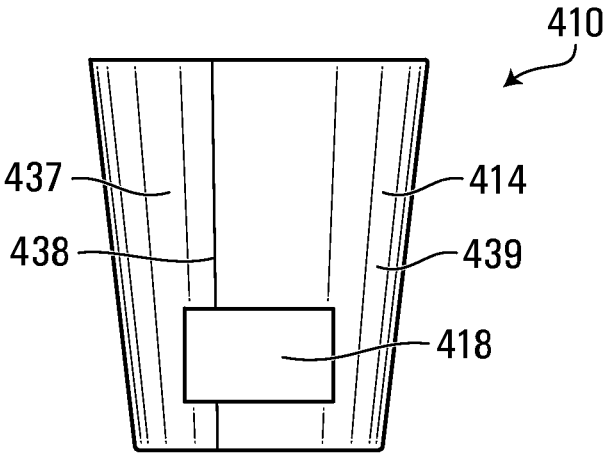
FIG. 18 is a front elevation view of the apparatus shown in FIG. 18.
Figure 20:
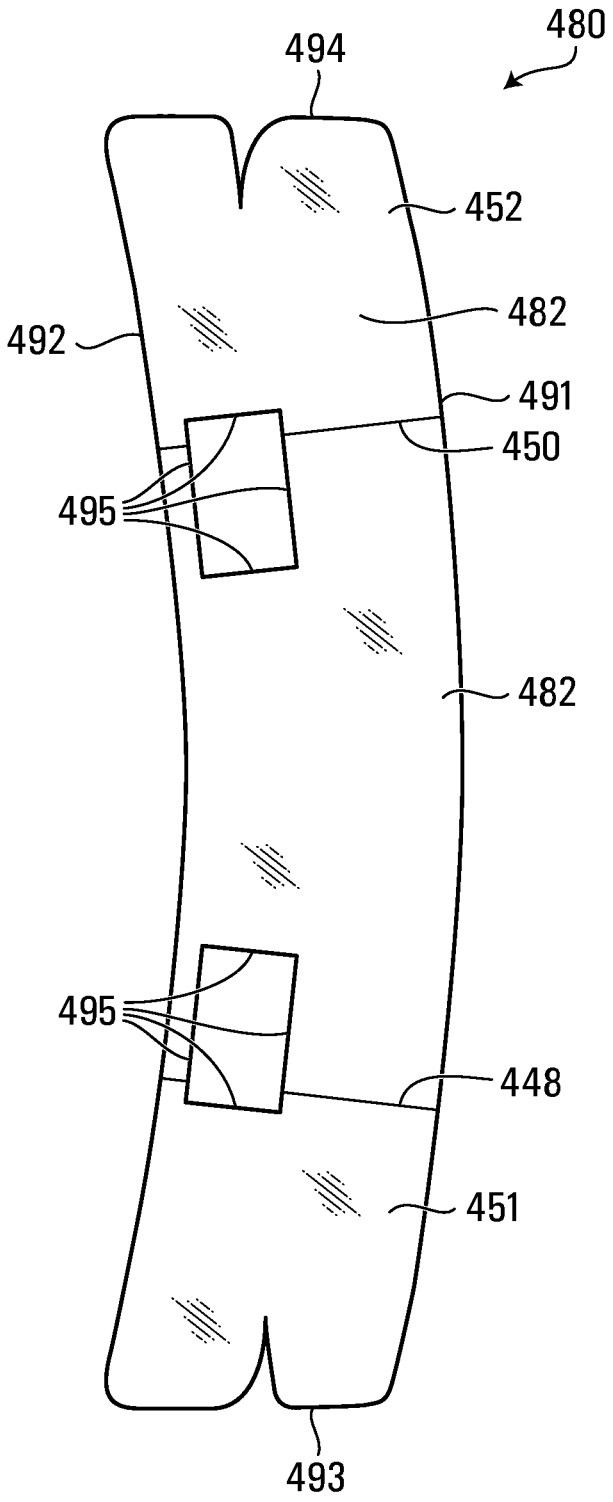
FIG. 20 is a blank precursor for forming the apparatus shown in FIGS. 17 to 19.
Figure 21:
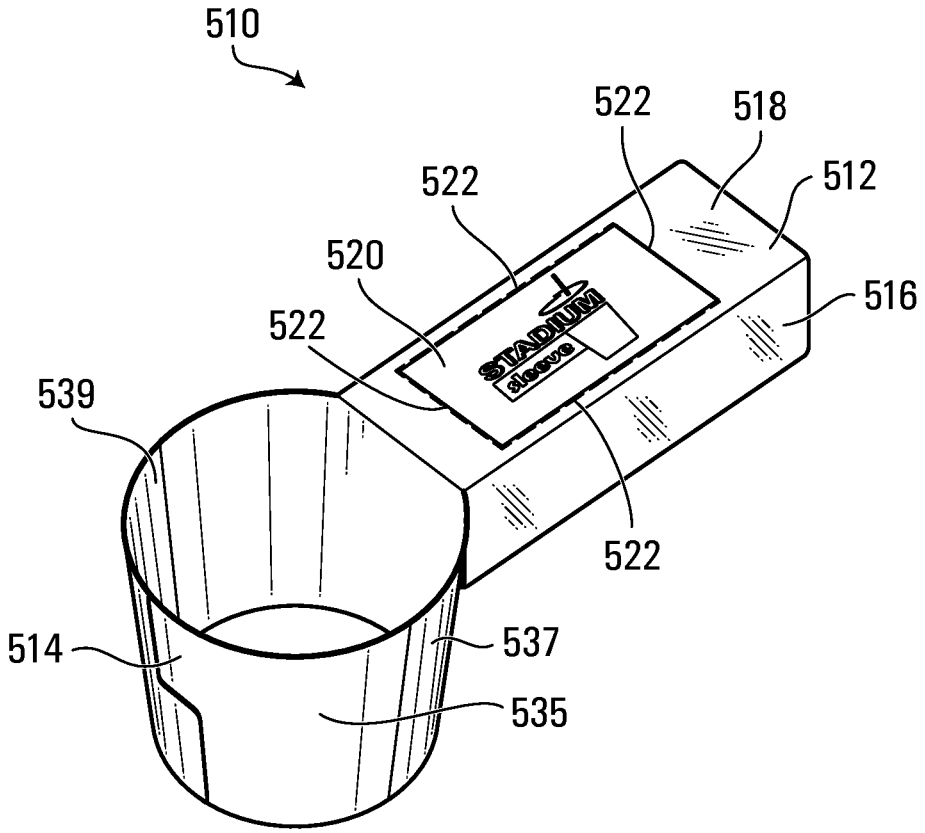
FIG. 21 is a perspective view of an apparatus for supporting a food item according to a fifth embodiment of the invention.

Referring to FIG. 20, a blank precursor for forming the apparatus shown in FIGS. 17 to 19 is shown generally at 480. The blank precursor 480 includes a generally crescent shaped support panel 482 for forming a support portion, i.e. the support portion 414 shown in FIGS. 16 to 18. The support panel 414 includes top and bottom edges 491 and 492 and opposing support panel side edges 493 and 494. The support panel 482 further includes fold lines 448 and 450, which provide sidewall edges 438 and 440 when folded. A support panel portion 451 extending between the fold line 448 and the support panel side edge 493 forms the sidewall 435 shown in FIG. 17, whereas a support panel portion 452 extending between the fold line 450 and the support panel side edge 494 forms the sidewall 439 shown in FIG. 17. A support panel portion 453 between the fold lines 448 and 450 forms the sidewall 437 shown in FIG. 17. Portions of the support panel portions 451 and 452 adjacent the support panel side edges 493 and 494 may be joined to form a support portion for receiving and supporting the food item, i.e. the support portion 414 in FIGS. 17 to 19. Again, the support panel portions 451 and 452 may be joined by gluing the portions together using an adhesive. In other embodiments, the support panel portions 451 and 452 may be joined using staples, or a clasp, or a tab extending from one of the sidewalls that is received and locked by a notch in the other sidewall, for example. In the illustrated embodiment, they are joined together at least by a clasp structure.

An apparatus for supporting a food item according to a fifth embodiment of the invention is shown generally at 510 in FIG. 20. Referring to FIG. 20, the apparatus 510 is similar to the apparatus illustrated in FIGS. 1 to 6 and further includes an area 520 for receiving an image such as an advertisement, notification, promotion, or other information, for example. Alternatively, a left panel 516, top panel 518, or right panel (not shown) of the sleeve 512, and the sidewalls 535, 537, and 539 of support portion 514, also may provide areas for the placement of images. The images may be placed on apparatus 510 as a decal or sticker. Alternatively the image may be printed on the blank precursor prior to assembly of the apparatus, especially where the apparatus is made using a lignocellulosic material, which facilitates inexpensive printing of images.

In the illustrated embodiment, a logo is printed in the area 520 on the top panel 518, and in the embodiment shown, may be bordered by a border formed by frangible lines 522 in top panel 518, such that the portion of the top panel on which the logo is printed may be conveniently removed from apparatus 510 by breakage of the frangible lines. The printed area may alternatively include contact information, promotional coupons to be redeemed, a QR code, or any other piece of information that one may wish to communicate to a patron.

While specific embodiments of the invention have been described and illustrated, such embodiments should be considered illustrative of the invention only and not as limiting the invention as construed in accordance with the accompanying claims.

What is claimed is:

1. A system for supporting a food item, the system comprising:

an arm rest of a seat;

a sleeve operable to slide over the armrest, the sleeve being collapsible when not in use, wherein the sleeve comprises a plurality of panels joined along edges thereof to define an enclosed opening for receiving the armrest in the sleeve, whereby the sleeve completely surrounds a portion of the armrest, and wherein the plurality of panels includes a bottom panel for engaging an undersurface of the armrest when the armrest is received in the opening; and a support portion extending from the sleeve and being operable to receive and support the food item.

2. A system for supporting a food item, the system comprising:

an arm rest of a seat;

a sleeve operable to slide over the armrest, the sleeve being collapsible when not in use, wherein the sleeve comprises a plurality of panels joined along edges thereof to define an opening for receiving the armrest in the sleeve, and wherein the plurality of panels includes a bottom panel for engaging an undersurface of the armrest when the armrest is received in the opening; and a support portion extending from the sleeve and being operable to receive and support the food item;

wherein the edges are configured to flex to permit the sleeve to collapse flat when not in use.

3. The system of claim 2 further comprising a slit extending partway along the bottom panel from the opening.

4. The system of claim 2 wherein the panels comprise generally rectangular panels.

5. The system of claim 4 wherein the sleeve comprises a joint between at least two of the plurality of panels.

6. The system of claim 5 wherein the joint comprises a glued joint.

7. The system of claim 5 wherein the joint comprises corresponding closure tabs operable to engage to join the at least two of the plurality of panels.

8. The system of claim 2 wherein the support portion is collapsible to a flat condition.

9. The system of claim 8 wherein the support portion and the sleeve are collapsible into a generally common plane for storage in a flat condition.

10. The system of claim 2 further comprising a connecting portion connecting the sleeve to the support portion.

11. The system of claim 10 wherein the support portion is joined to the sleeve along an edge.

12. The system of claim 10 wherein the connecting portion is configured to flex to permit the support portion to be oriented to receive the food item.

13. The system of claim 12 wherein the support portion includes a sidewall and wherein the sleeve is configured to engage and support the sidewall of the support portion when the support portion is oriented to receive the food item.

14. The system of claim 2 wherein the support portion has a generally cylindrical shape and includes an opening for receiving a beverage container.

15. The system of claim 2 wherein at least one of the support portion and the sleeve comprises a flexible material.

16. The system of claim 2 wherein the support portion and sleeve are integrally formed.

17. The system of claim 2 wherein the support portion extends outwardly from an end of the sleeve.

18. The system of claim 2 wherein the support portion is configured to extend above an upper surface of the sleeve and be supported by the upper surface of the sleeve when in use.

19. The system of claim 2 fabricated from lignocellulosic material.

* * * * *